US006955218B2

(12) United States Patent
Coon et al.

(10) Patent No.: US 6,955,218 B2
(45) Date of Patent: Oct. 18, 2005

(54) PLACING FIBER OPTIC SENSOR LINE

(75) Inventors: Robert J. Coon, Missouri City, TX (US); John R. Setterberg, Jr., Huntsville, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 61 days.

(21) Appl. No.: 10/642,402

(22) Filed: Aug. 15, 2003

(65) Prior Publication Data

US 2005/0034873 A1 Feb. 17, 2005

(51) Int. Cl.[7] ..... E21B 43/08
(52) U.S. Cl. ..... 166/250.01; 166/66
(58) Field of Search ..... 166/250.01, 65.1, 166/66, 242.2

(56) References Cited

U.S. PATENT DOCUMENTS

| | | | | |
|---|---|---|---|---|
| 5,503,225 | A * | 4/1996 | Withers | 166/250.1 |
| 5,804,713 | A | 9/1998 | Kluth | 73/152.01 |
| 6,116,578 | A | 9/2000 | Pruett | 254/134.4 |
| 6,408,943 | B1 * | 6/2002 | Schultz et al. | 166/285 |
| 6,446,723 | B1 * | 9/2002 | Ramos et al. | 166/285 |
| 6,644,402 | B1 | 11/2003 | Sharma et al. | 166/250.01 |
| 6,684,951 | B2 * | 2/2004 | Restarick et al. | 166/250.01 |
| 2002/0125008 | A1 | 9/2002 | Wetzel et al. | |
| 2002/0125009 | A1 | 9/2002 | Wetzel et al. | |
| 2003/0010500 | A1 | 1/2003 | Smith | |
| 2003/0085815 | A1 * | 5/2003 | Tilton et al. | 340/854.4 |

FOREIGN PATENT DOCUMENTS

| | | |
|---|---|---|
| GB | 2 366 817 | 3/2002 |
| GB | 2 383 061 | 6/2003 |

OTHER PUBLICATIONS

U.K. Search Report, Application No. GB 0417656.6, dated Dec. 1, 2004.

* cited by examiner

*Primary Examiner*—William Neuder
(74) *Attorney, Agent, or Firm*—Moser, Patterson & Sheridan, L.L.P.

(57) ABSTRACT

The present invention generally relates to a method and an apparatus for placing fiber optic control line in a wellbore. In one aspect, a method for placing a line in a wellbore is provided. The method includes providing a tubular in the wellbore, the tubular having a first conduit operatively attached thereto, whereby the first conduit extends substantially the entire length of the tubular. The method further includes aligning the first conduit with a second conduit operatively attached to a downhole component and forming a hydraulic connection between the first conduit and the second conduit thereby completing a passageway therethrough. Additionally, the method includes urging the line through the passageway. In another aspect, a method for placing a control line in a wellbore is provided. In yet another aspect, an assembly for an intelligent well is provided.

21 Claims, 6 Drawing Sheets

PLACING FIBER OPTIC SENSOR LINE

BACKGROUND OF THE INVENTION

1. Field of the Invention

Embodiments of the present invention generally relate to a wellbore completion. More particularly, the invention relates to placing sensors in a wellbore. Still more particularly, the invention relates to placing fiber optic sensor line in a wellbore.

2. Description of the Related Art

During the past 10 years decline rates have doubled while at the same time, reservoirs are becoming more complex. Consequently, the aggressive development and installation of new technologies have become essential, such as intelligent well technology. Since downhole measurements play a critical role in the management of oil and gas reservoirs, intelligent well technology has come to the forefront. But like many new technologies, successful and reliable development of intelligent well techniques has been a challenge to design.

Prior to the introduction of permanently deployed in-well reservoir-monitoring systems, the only viable method to obtain downhole information was through the use of intervention-based logging techniques. Interventions would be conducted periodically to measure a variety of parameters, including pressure, temperature and flow. Although well logs provide valuable information, an inherently costly and risky well-intervention operation is required. As a result, wells were typically logged infrequently. The lack of timely data often compromised the ability of the operator to optimize production.

A new down-hole technology to better monitor and control production without intervention would represent a significant value to the industry. However, the challenge was to develop a cost-effective and reliable solution to integrate permanent-monitoring systems with flow control systems to deliver intelligent wells. Using a permanent monitoring system, intelligent wells have the capability to obtain a wide variety of measurements that make it easier to characterize oil and gas reservoirs. These measurements are designed to locate and track fluid fronts within the reservoir and for seismic interrogation of the rock strata within the reservoir. Additionally, intelligent completion systems are being developed to determine the types of fluids being produced prior to and after completion. Using permanent remote sensing and fiber optics, an analyzer can monitor the well's performance and production abnormalities can be detected earlier in the life cycle of the well, which can be corrected before becoming a major problem.

One challenge facing the progress of intelligent completion systems is the development of an efficient and a cost effective method of deploying fiber optic line in the wellbore. In the past several years, various deployment techniques have been developed. For example, a method for installing fiber optic line in a well is disclosed in U.S. Pat. No. 5,804,713. In this deployment technique, a conduit is wrapped around a string of production tubing prior to placing into the well. The conduit includes at least one sensor location defined by a turn in the conduit. After the string of production tubing is placed in the well, a pump is connected to an upper end of the conduit to provide a fluid to facilitate the placement of the fiber optic line in the conduit. Thereafter, the fiber optic line is introduced into the conduit and subsequently pumped through the conduit until it reaches the at least one sensor location. Using this technique for deploying fiber optic line in the wellbore presents various drawbacks. For example, a low viscosity fluid must be maintained at particular flow rate in order to locate the fiber optic line at a specific sensor location. In another example, a load is created on the fiber optic line as it is pumped through the conduit, thereby resulting in possible damage of the fiber optic line.

Another deployment technique for inserting a fiber optic line in a duct is disclosed in U.S. Pat. No. 6,116,578. In this deployment technique, a source of fiber optic line is positioned adjacent the wellbore having a pressure housing apparatus at the surface thereof. Thereafter, the fiber optic line is inserted through the pressure housing apparatus and subsequently into a tube by means of an expandable polymer foam mixture under pressure. As the polymer foam mixture expands, the foam adheres to the surface of the fiber optic line creating a viscous drag against the fiber optic line in the direction of pressure flow. The fiber optic line is subsequently urged through the duct to a predetermined location in the wellbore. Using this technique for deploying fiber optic line in the wellbore presents various drawbacks. For example, additional complex equipment, such as the pressure housing apparatus, is required to place the fiber optic line into the wellbore. In another example, the foam coating on the fiber optic line may not adequately protect the fiber optic line from mechanical forces generated during deployment into the duct, thereby resulting in possible damage of the fiber optic line. Furthermore, this deployment technique is complex and expensive.

A need therefore exists for a cost effective method of placing a fiber optic line in a wellbore. There is a further need for a method that protects the fiber optic line from damage during the deployment operation. Furthermore, there is a need for a method of placing a fiber optic line in a wellbore that does not depend on a specific flow rate or a specific viscosity fluid.

SUMMARY OF THE INVENTION

The present invention generally relates to a method and an apparatus for placing fiber optic sensor line in a wellbore. In one aspect, a method for placing a line in a wellbore is provided. The method includes providing a tubular in the wellbore, the tubular having a first conduit operatively attached thereto, whereby the first conduit extends substantially the entire length of the tubular. The method further includes aligning the first conduit with a second conduit operatively attached to a downhole component and forming a hydraulic connection between the first conduit and the second conduit thereby completing a passageway therethrough. Additionally, the method includes urging the line through the passageway.

In another aspect, a method for placing a sensor line in a wellbore is provided. The method includes placing a tubular in the wellbore, the tubular having a first conduit operatively attached thereto, whereby the first conduit extends substantially the entire length of the tubular. The method further includes pushing a fiber in metal tubing through the first conduit.

In yet another aspect, an assembly for an intelligent well is provided. The assembly includes a tubular having a first conduit operatively attached thereto and a fiber in metal tubing deployable in the first conduit.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope for the invention may admit to other equally effective embodiments.

DETAILED DESCRIPTION OF THE PREFERRED EMBODIMENTS

Embodiments of the present invention generally provide a method and an apparatus for placement of a sensor arrangement in a well, such as fiber optic sensor, to monitor various characteristics of the well. For ease of explanation, the invention will be described generally in relation to a cased vertical wellbore with a sand screen and a gravel pack disposed at the lower end thereof. It is to be understood, however, that the invention may be employed in a wellbore without either a sand screen or a gravel pack. Furthermore, the invention may be employed in a horizontal wellbore or a diverging wellbore.

Figure 1:
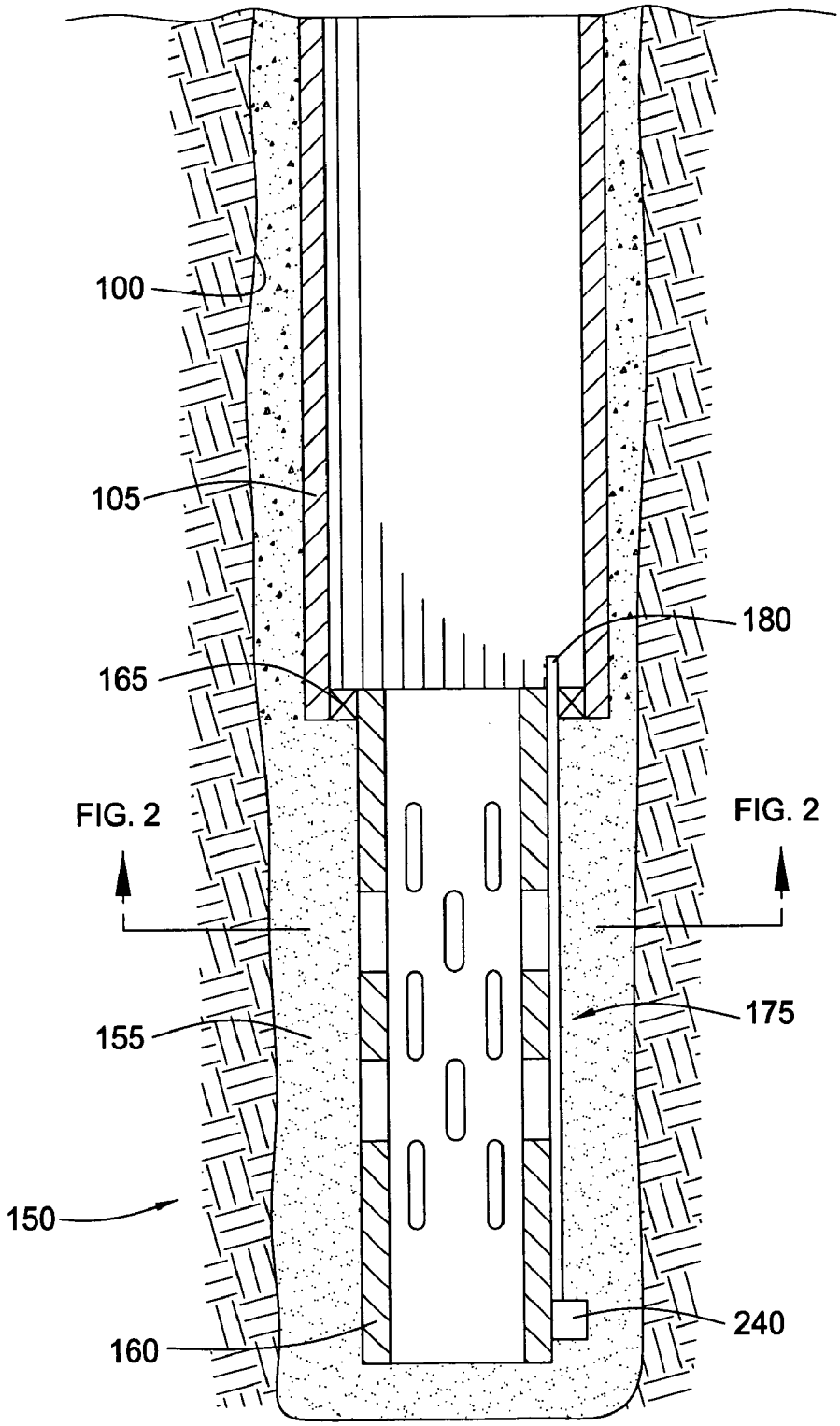
FIG. 1 is a cross-sectional view illustrating a wellbore with a gravel pack disposed at a lower end thereof.

FIG. 1 is a cross-sectional view illustrating a wellbore 100 with a gravel pack 150 disposed at a lower end thereof. As depicted, the wellbore 100 is lined with a string of casing 105. The casing 105 provides support to the wellbore 100 and facilitates the isolation of certain areas of the wellbore 100 adjacent hydrocarbon bearing formations. The casing 105 typically extends down the wellbore 100 from the surface of the well to a designated depth. An annular area is thus defined between the outside of the casing 105 and the earth formation. This annular area is filled with cement to permanently set the casing 105 in the wellbore 100 and to facilitate the isolation of production zones and fluids at different depths within the wellbore 100. It should be noted, however, the present invention may also be employed in an uncased wellbore, which is referred to as an open hole completion.

As illustrated, the gravel pack 150 is disposed at the lower end of the casing 105. The gravel pack 150 provides a means of controlling sand production. Preferably, the gravel pack 150 includes a large amount of gravel 155 (i.e., "sand") placed around the exterior of a slotted, perforated, or other type liner or screen tubular 160. Typically, the screen tubular 160 is attached to a lower end of the casing 105 by a packer arrangement 165. The gravel 155 serves as a filter to help assure that formation fines and sand do not migrate with the produced fluids into the screen tubular 160.

During a typical gravel pack completion operation, a tool (not shown) disposed at a lower end of a work or production tubing string (not shown) places the screen tubular 160 and the packer arrangement 165 in the wellbore 100. Generally, the tool includes a production packer and a cross-over. Thereafter, gravel 155 is mixed with a carrier fluid to form a slurry and then pumped down the tubing through the cross-over into an annulus formed between the screen tubular 160 and the wellbore 100. Subsequently, the carrier fluid in the slurry leaks off into the formation and/or through the screen tubular 160 while the gravel 155 remains in the annulus. As a result, the gravel 155 is deposited in the annulus around the screen tubular 160 where it forms the gravel pack 150.

In the embodiment illustrated in FIG. 1, a lower control line 175 is operatively attached to an outer surface of the screen tubular 160 by a connection means well-known in the art, such as clips, straps, or restraining members prior to deployment into the wellbore 100. Generally, the lower control line 175 is tubular that is constructed and arranged to accommodate a sensor line (not shown) therein and extends substantially the entire outer length of the screen tubular 160. In an alternative embodiment, the lower control line 175 may be operatively attached to an interior surface of the screen tubular 160. In this embodiment, the lower control line 175 is substantially protected during deployment and placement of the screen tubular 160. In either case, the lower control line 175 includes a conduit end 180 at an upper end thereof and a check valve 240 disposed at a lower end thereof.

Figure 2:
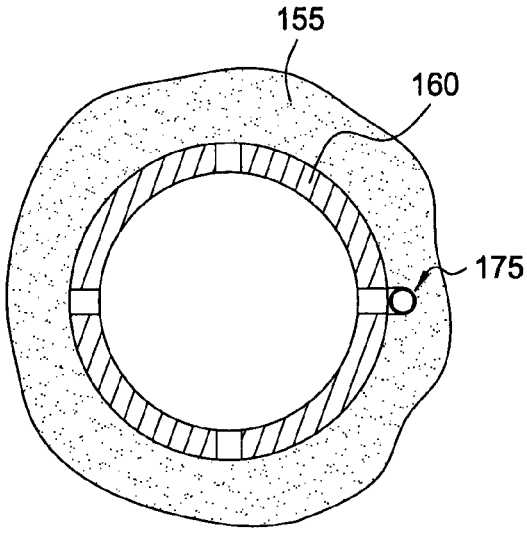
FIG. 2 is a cross-sectional view illustrating a lower control line operatively attached to a screen tubular.

FIG. 2 is a cross-sectional view illustrating the lower control line 175 operatively attached to the screen tubular 160. As shown, the lower control line 175 is disposed adjacent the screen tubular 160. The lower control line 175 may be secured to the screen tubular by a connection means known in the art, such as clips, straps, or restraining members.

Figure 3:
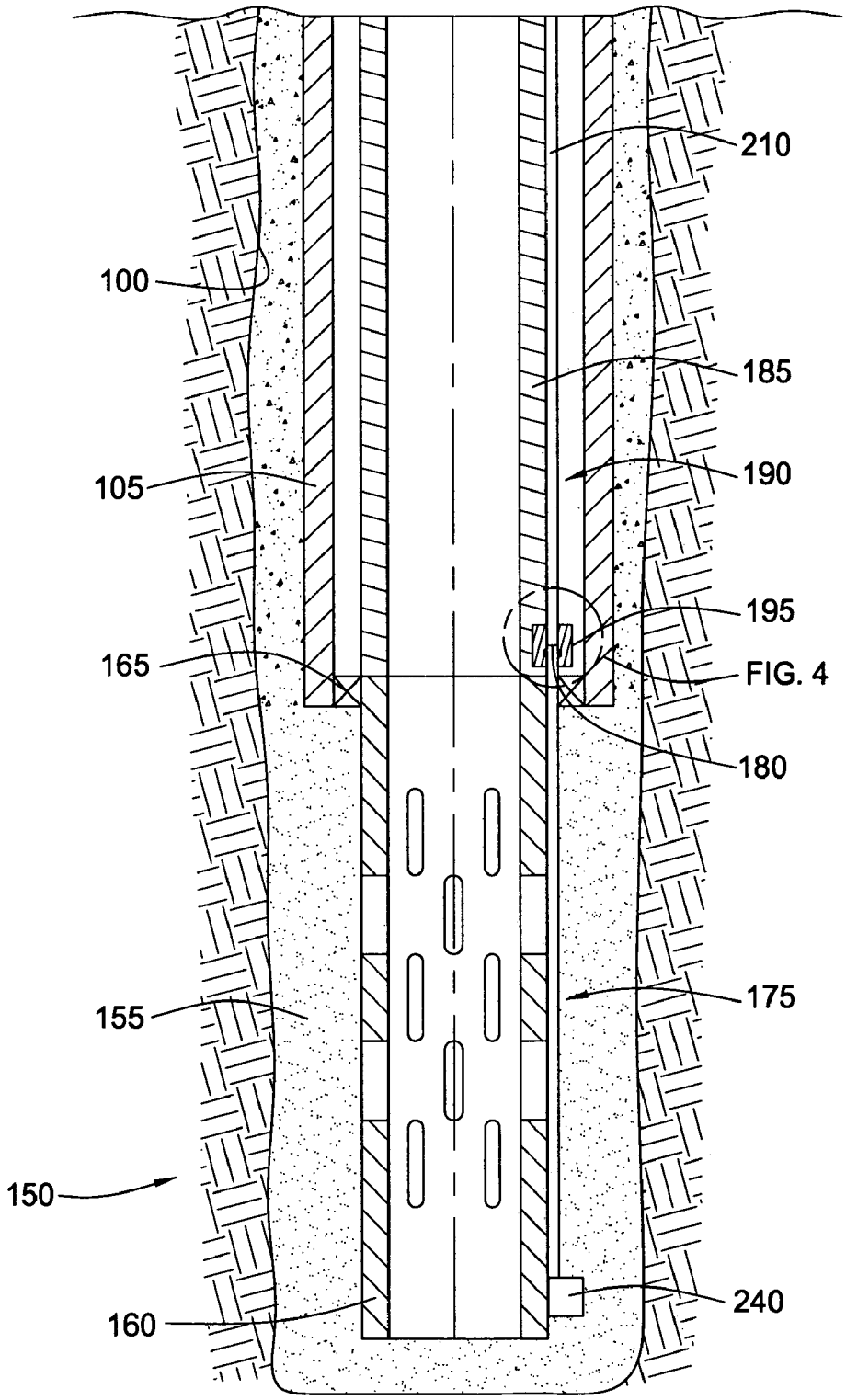
FIG. 3 is a cross-sectional view illustrating a string of production tubing disposed in the wellbore.

FIG. 3 is a cross-sectional view illustrating a string of production tubing 185 disposed in the wellbore 100. Prior to disposing the production tubing 185 into the wellbore 100, a upper control line 190 is operatively attached to a outer surface thereof by a connection means well-known in the art, such as clips, straps, or restraining members. Similar to lower control line 175, the upper control line 190 is constructed and arranged to accommodate a sensor line (not shown) therein. Typically, the upper control line 190 extends substantially the entire outer length of the production tubing 185. In an alternative embodiment, the upper control line 190 may be disposed to an interior surface of the production tubing 185. In this embodiment, the upper control line 190 is substantially protected during deployment and placement of the production tubing 185. In either case, the upper control line 190 includes a hydraulic connect end 195 that mates with the upper conduit end 180 on the lower control line 175.

As the production tubing 185 is lowered into the wellbore 100, it is orientated by a means well-known in the art to substantially align the upper control line 190 with the lower control line 175. For example, the production tubing 185 may include an orientation member (not shown) located proximal the lower end thereof and the screen tubular 160 may include a seat (not shown) disposed at an upper end thereof. The seat includes edges that slope downward toward a keyway (not shown) formed in the seat. The keyway is constructed and arranged to receive the orientation member on the production tubing 185. As the production tubing 185 is lowered, the orientation member contacts the sloped edges on the seat and is guided into the keyway, thereby rotationally orientating the production tubing 185 relative to the screen tubular 160.

Preferably, the production tubing 185 is lowered until the hydraulic connect end 195 substantially contacts the upper conduit end 180. At this time, the connection between the upper control line 190 and the lower control line 175 creates a passageway 210 that extends from the surface of the wellbore 100 to the lower end of the screen tubular 160. Prior to inserting a sensor therein, the passageway 210 is cleaned by pumping fluid therethrough to remove any sand or other accumulated wellbore material. After the passageway 210 is cleaned, the check valve 240 prevents further material from accumulating in the passageway 210 from the lower end of the wellbore 100. Alternatively, a u-tube arrangement (not shown) could be employed in place of the check valve 240 to prevent further material from accumulating in the passageway 210.

Figure 4:
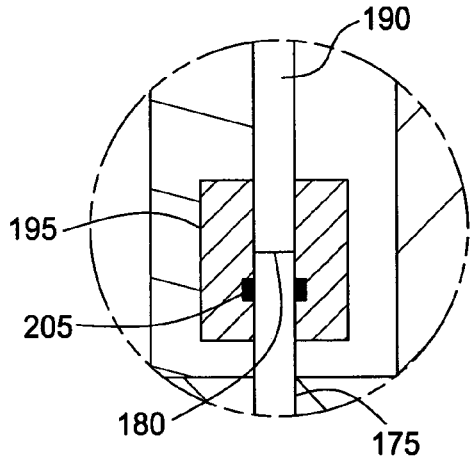
FIG. 4 is an enlarged view illustrating a hydraulic connection between an upper control line and the lower control line.

FIG. 4 is an enlarged view illustrating the hydraulic connection between the upper control line 190 and the lower control line 175. As shown, the hydraulic connect end 195 has been aligned with the upper conduit end 180. As further shown, a plurality of seals 205 in the hydraulic connect end 195 contact the conduit end 180 to create a fluid tight seal therebetween.

Figure 5:
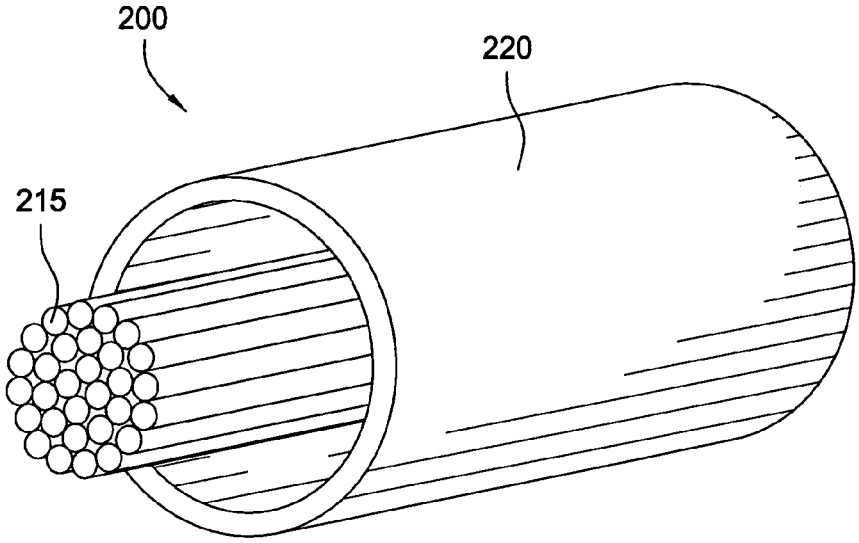
FIG. 5 is an isometric view illustrating a sensor line for use with the present invention.

FIG. 5 is an isometric view illustrating a sensor line 200 for use with the present invention. Preferably, the sensor line 200 consists of a fiber in metal tube ("FIMT"), which includes a plurality of optical fibers 215 encased in a metal tube 220, such as steel or aluminum tube. The metal tube 220 is constructed and arranged to protect the fibers 215 from a harmful wellbore environment that may include a high concentration of hydrogen, water, or other corrosive wellbore fluid. Additionally, the metal tube 220 protects the fibers 215 from mechanical forces generated during the deployment of the sensor line 200, which could damage the fibers 215. Preferably, a gel (not shown) is inserted into the metal tube 220 along with the fibers 215 for additional protection from humidity, and to protect the fibers 215 from the attack of hydrogen that may darken the fibers 215 causing a decrease in optical performance. In an alternative embodiment, the sensor line 200 consists of a plurality of optical fibers 215 encased in a protective polymer sheath (not shown), such as Teflon, Ryton, or PEEK. In this embodiment, the protective sheath may include an integral cup-shaped contours molded into the sheath to facilitate pumping the sensor line 200 down the control lines 190, 175. In some embodiments, the sensor line 200 may include electrical lines, hydraulic lines, fiber optic lines, or a combination thereof.

Figure 6:
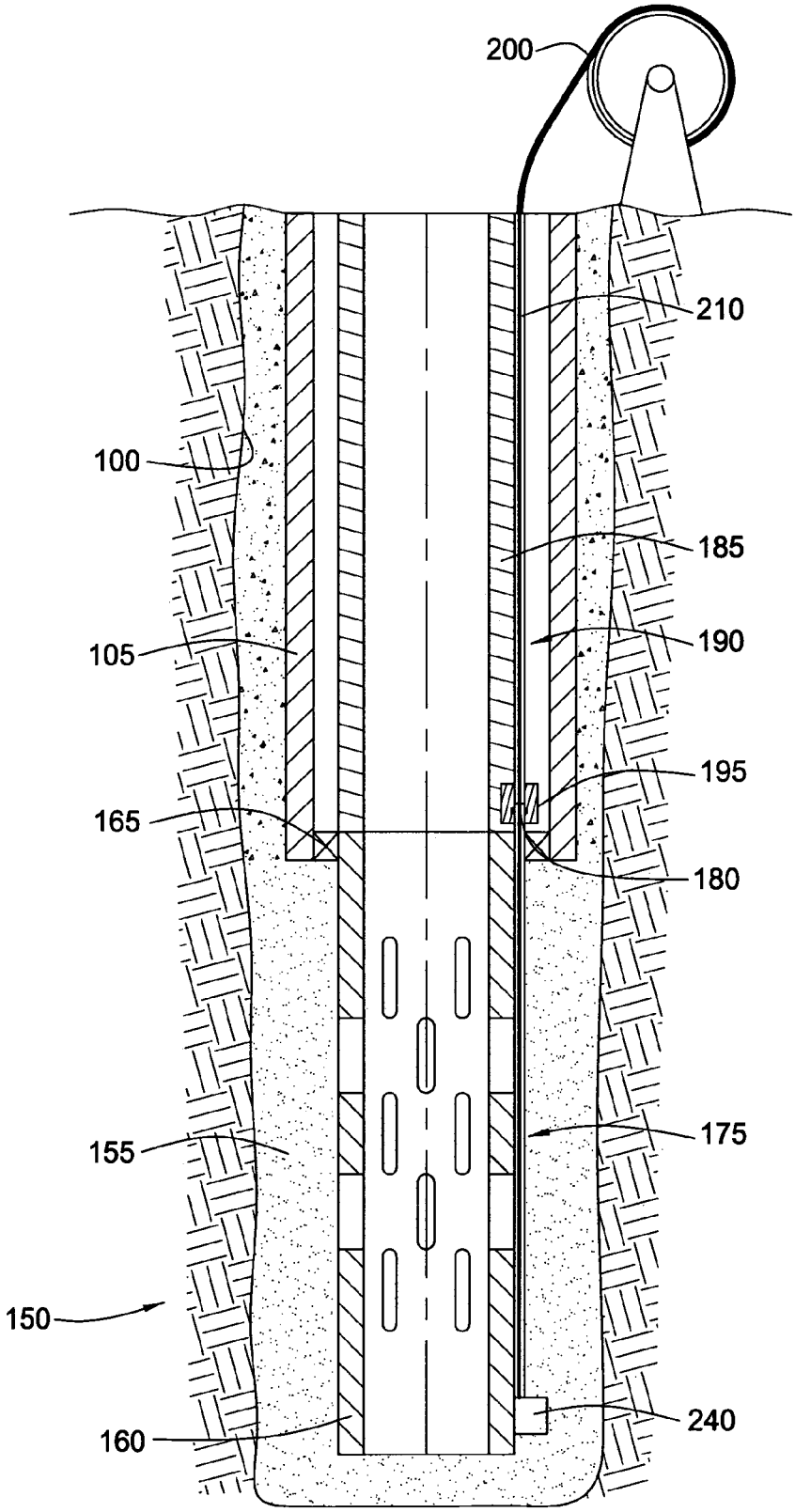
FIG. 6 is a cross-sectional view illustrating the sensor line mechanically disposed in a passageway.

FIG. 6 is a cross-sectional view illustrating the sensor line 200 mechanically disposed in the passageway 210. Preferably, the sensor line 200 is placed at the surface of the wellbore 100 on a roll for ease of transport and to facilitate the placement of the sensor line 200 into the wellbore 100. Thereafter, a leading edge of the sensor line 200 is introduced into the passageway 210 at the top of the upper control line 190. Then, the sensor line 200 is urged by a mechanical force through the entire passageway 210 consisting of the upper control line 190, hydraulic connect 195, and the lower control line 175. Preferably, the mechanical force is generated by a gripping mechanism (not shown) or by another means well-known in the art that physically pushes the sensor line 200 through the passageway 210 until the leading edge of the sensor line 200 reaches a predetermined location proximate the check valve 240. Typically, an increase in pressure in the passageway 210 indicates that the leading edge has reached the predetermined location. Alternatively, the length of sensor line 200 inserted in the passageway 210 is monitored and compared to the relative length of the passageway 210 to provide a visual indicator that the leading edge has reached the predetermined location.

Figure 7:
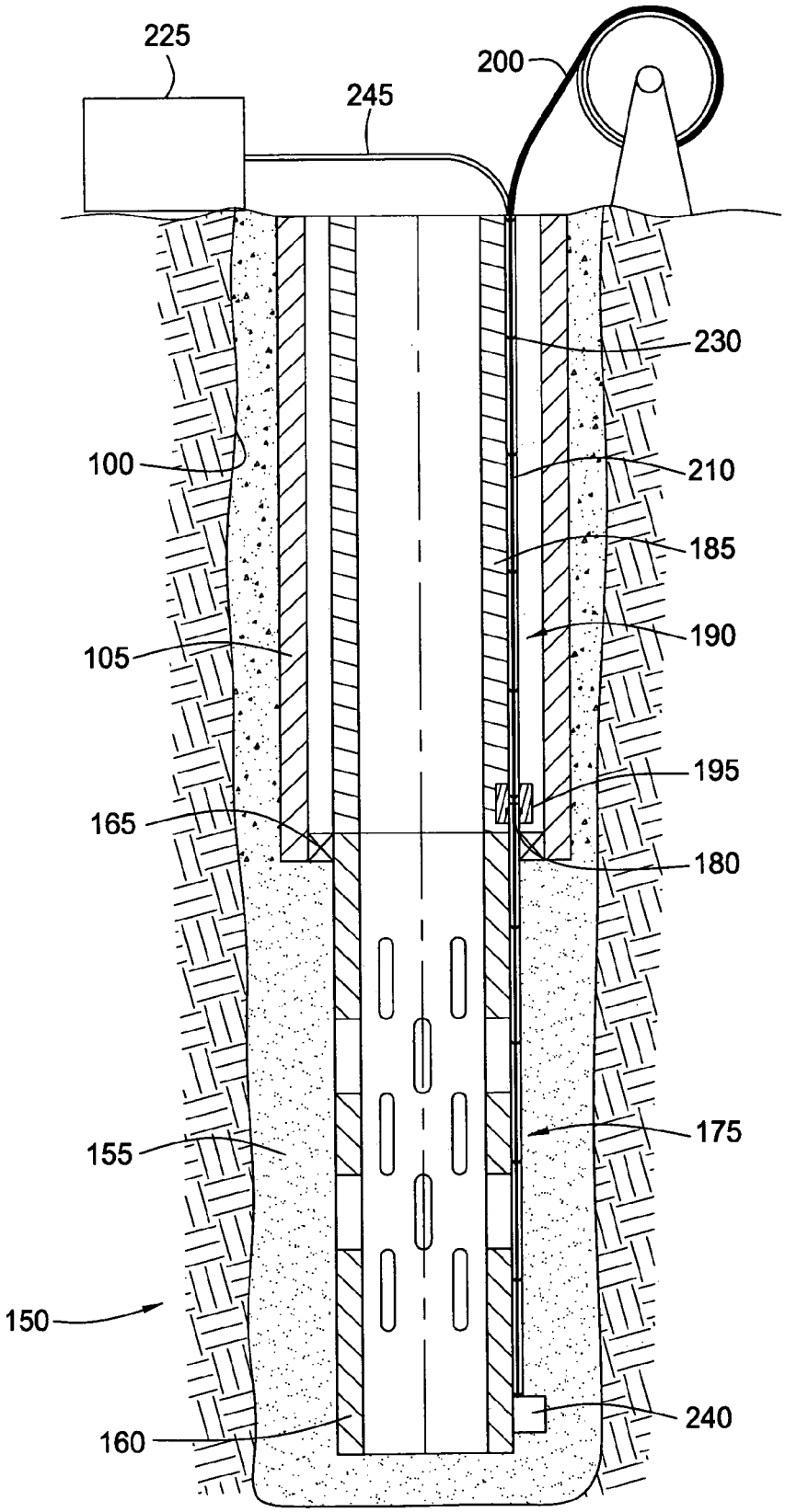
FIG. 7 is a cross-sectional view illustrating the sensor line hydraulically disposed in the passageway.

FIG. 7 is a cross-sectional view illustrating the sensor line 200 hydraulically disposed in the passageway 210. In this embodiment, a plurality of flow cups 230 are operatively attached to the sensor line 200 prior to inserting the leading edge into the passageway 210. The plurality of flow cups 230 are constructed and arranged to facilitate the movement of the sensor line 200 through the passageway 210. Typically, the flow cups 230 are fabricated from a flexible watertight material, such as elastomer. The flow cups 230 are spaced on the sensor line 200 in such a manner to increase the hydraulic deployment force created by a fluid that is pumped through the passageway 210.

Typically, a fluid pump 225 is disposed at the surface of the wellbore 100 to pump fluid through the passageway 210. Preferably, the fluid pump 225 is connected to the top of the passageway 210 by a connection hose 245. After the sensor line 200 and the flow cups 230 are introduced into the top of the passageway 210, the fluid pump 225 urges fluid through the connection hose 245 into the passageway 210. As the fluid contacts the flow cups 230, a hydraulic force is created to urge the sensor line 200 through the passageway 210. Preferably, the fluid pump 225 continues to introduce fluid into the passageway 210 until the leading edge of the sensor line 200 reaches the predetermined location proximate the check valve 240. Thereafter, the fluid flow is stopped and the hose 245 is disconnected from the passageway 210.

Figure 8:
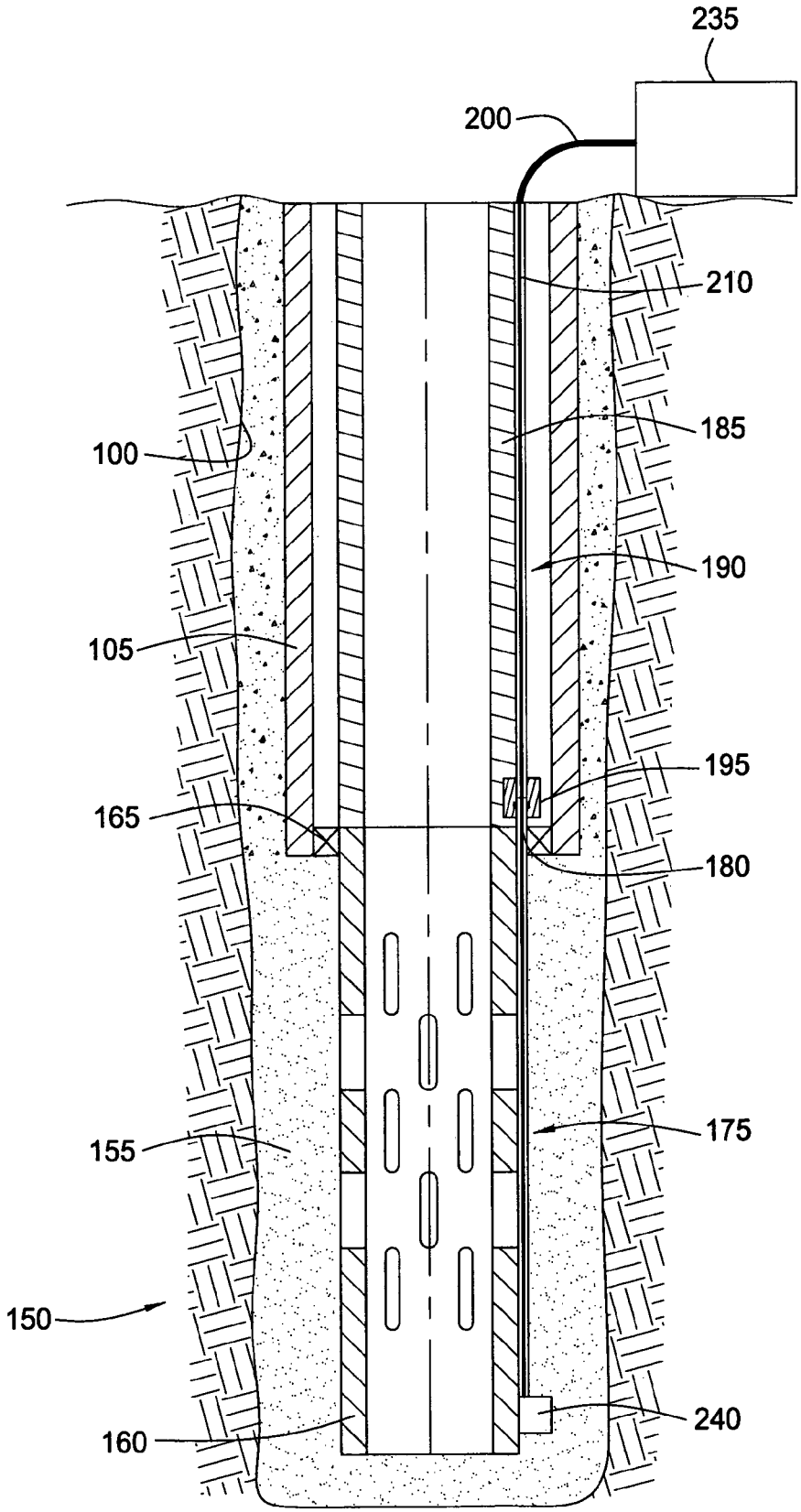
FIG. 8 is a cross-sectional view illustrating the sensor line connected to a data collection box.

FIG. 8 is a cross-sectional view illustrating the sensor line 200 connected to a data collection box 235. Generally, the data collection box 235 collects data measured by the sensor line 200 at various locations in the wellbore 100. Such data may include temperature, seismic, pressure, and flow measurements. In one embodiment, the sensor line 200 is used for distributed temperature sensing ("DTS"), whereby the data collection box 235 compiles temperature measurements at specific locations along the length of the sensor line 200. More specifically, DTS is a technique that measures the temperature distribution along the plurality of optical fibers 215.

Generally, a measurement is taken along the optical fiber 215 by launching a short pulse from a laser into the fiber 215. As the pulse propagates along the fiber 215 it will be attenuated or weakened by absorption and scattering. The scattered light will be sent out in all directions and some will be scattered backward within the fiber's core and this radiation will propagate back to a transmitter end where it can be detected. The scattered light has several spectral components most of which consists of Rayleigh scattered light that is often used for optical fiber attenuation measurements. The wavelength of Rayleigh light is the same as for the launched laser light.

DTS uses a process where light is scattered at a slightly different wavelength than the launched wavelength. The process is referred to as Raman scattering which is temperature dependent. Generally, a time delay between the launch of the short pulse from the laser into the fiber 215 and its subsequent return indicates the location from which the scatter signal is coming. By measuring the strength of the Raman scattered signal as a function of the time delay, it is possible to determine the temperature at any point along the fiber 215. In other words, the measurement of the Raman scattered signal relative to the time delay indicates the temperature along the length of the sensor line 200.

In another embodiment, the sensor line 200 may include fiber optic sensors (not shown) which utilize strain sensitive Bragg grating (not shown) formed in a core of one or more optical fibers 215. The fiber optic sensors may be combination pressure and temperature (P/T) sensors, similar to those described in detail in commonly-owned U.S. Pat. No. 5,892,860, entitled "Multi-Parameter Fiber Optic Sensor For Use In Harsh Environments", issued Apr. 6, 1999 and incorporated herein by reference. Further, for some embodiments, the sensor line 200 may utilize a fiber optic differential pressure sensor (not shown), velocity sensor (not shown) or speed of sound sensor (not shown) similar to those described in commonly-owned U.S. Pat. No. 6,354,147, entitled "Fluid Parameter Measurement In Pipes Using Acoustic Pressures", issued Mar. 12, 2002 and incorporated herein by reference. Bragg grating-based sensors are suitable for use in very hostile and remote environments, such as found downhole in wellbores.

In operation, a tubular is placed in a wellbore. The tubular having a first conduit operatively attached thereto, whereby the first conduit extends substantially the entire length of the tubular. Thereafter, the first conduit is aligned with a second conduit operatively attached to a downhole component, such as a sand screen. Next the first conduit and the second conduit are attached to form a hydraulic connection therebetween and thus creating a passageway therethrough. Subsequently, a sensor line, such as a fiber in metal tube, is urged through the passageway.

While the foregoing is directed to embodiments of the present invention, other and further embodiments of the invention may be devised without departing from the basic scope thereof, and the scope thereof is determined by the claims that follow.

What is claimed is:

1. A method for placing a line in a wellbore, comprising:

providing a tubular in the wellbore, the tubular having a first conduit attached thereto, whereby the first conduit extends substantially the entire length of the tubular;

aligning the first conduit with a second conduit operatively attached to a downhole component;

forming a hydraulic connection between the first conduit and the second conduit thereby completing a passageway therethrough; and urging the line through the passageway.

2. The method of claim 1, wherein the line is mechanically urged through the passageway.

3. The method of claim 1, further including pumping a fluid into the passageway to urge the line hydraulically through the conduit.

4. The method of claim 3, further including placing at least one flow cup on the line prior to urging the line through the passageway.

5. The method of claim 1, wherein the line comprises an optical fiber.

6. The method of claim 5, wherein the optical fiber provides a distributed temperature measurement.

7. The method of claim 5, wherein the optical fiber is disposed in a protective tube.

8. The method of claim 1, wherein the downhole component is a sand screen.

9. The method of claim 1, wherein the line is an electrical line, hydraulic line, optical fiber line, or combinations thereof.

10. The method of claim 1, wherein the first conduit is attached to an outer edge of the tubular.

11. A method for placing a sensor line in a wellbore, comprising:

providing a tubular in the wellbore, the tubular having a first conduit operatively attached thereto, whereby the first conduit extends substantially the entire length of the tubular; and pushing a fiber in metal tubing through the first conduit.

12. The method of claim 11, wherein the fiber provides a distributed temperature measurement.

13. The method of claim 11, further including aligning the first conduit with a second conduit operatively attached to a downhole component and forming a hydraulic connection therebetween.

14. The method of claim 13, wherein the downhole component is a sand screen.

15. A method for placing a sensor line in a wellbore, comprising:

providing a tubular in the wellbore, the tubular having a first conduit operatively attached thereto, whereby the first conduit extends substantially the entire length of the tubular;

securing at least one flow cup on a fiber in metal tubing; and pumping the fiber in metal tubing through the first conduit with a fluid.

16. The method of claim 15, wherein the fiber provides a distributed temperature measurement.

17. The method of claim 15, further including aligning the first conduit with a second conduit operatively attached to a downhole component and forming a hydraulic connection therebetween.

18. The method of claim 17, wherein the downhole component is a sand screen.

19. An assembly for an intelligent well, comprising:

a tubular having a first conduit operatively attached thereto; and a fiber deployable in the first conduit, wherein a plurality of flow cups are disposed on the fiber to increase a hydraulic deployment force created by fluid pumped through the first conduit.

20. The assembly of claim 19, wherein the fiber is used for distributed temperature sensing.

21. The assembly of claim 19, further including a downhole component having a second conduit operatively attached thereto, wherein the first conduit and the second conduit are aligned to form a passageway.

* * * * *